US008392018B2

(12) United States Patent
Wang et al.

(10) Patent No.: US 8,392,018 B2
(45) Date of Patent: Mar. 5, 2013

(54) APPARATUS AND METHOD FOR DISTRIBUTING OPHTHALMIC LENSES

(75) Inventors: Daniel T. Wang, Jacksonville, FL (US); Edward R. Kernick, Jacksonville, FL (US); Hamid A. Darabi, Ponte Vedra, FL (US); Francis E. Mirmina, Jacksonville, FL (US); Gerhard Andrew Foelsche, Rehoboth, MA (US); David Logan Baker, Greene, RI (US); Breck Andrew Petrillo, Warren, RI (US); Carl B. Dumas, Tiverton, RI (US); Son Minh Luong, Cranston, RI (US); Benjamin Beaugh, Warwick, RI (US); Christopher T. Zirps, Sharon, MA (US)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 537 days.

(21) Appl. No.: 12/639,342

(22) Filed: Dec. 16, 2009

(65) Prior Publication Data

US 2010/0181332 A1 Jul. 22, 2010

Related U.S. Application Data

(60) Provisional application No. 61/171,593, filed on Apr. 22, 2009, provisional application No. 61/141,714, filed on Dec. 31, 2008.

(51) Int. Cl.
*G07F 9/00* (2006.01)

(52) U.S. Cl. ..... 700/236; 700/231; 700/232

(58) Field of Classification Search ..... 700/213, 700/214, 215, 216, 231, 232, 236
See application file for complete search history.

(56) References Cited

U.S. PATENT DOCUMENTS

| | | | |
|---|---|---|---|
| 2,932,383 | A | 4/1960 | Fagan |
| 3,130,823 | A | 4/1964 | Antonious |
| 4,150,744 | A | 4/1979 | Fennimore |
| 4,597,244 | A | 7/1986 | Pharo |
| 4,691,820 | A | 9/1987 | Martinez |
| 4,765,482 | A | 8/1988 | Delia |
| 4,791,411 | A | 12/1988 | Staar |
| 4,847,764 | A | 7/1989 | Halvorson |
| 4,865,186 | A | 9/1989 | Gates |
| 4,909,382 | A | 3/1990 | Cuppari |
| 4,985,280 | A | 1/1991 | Scholz et al. |
| 5,014,875 | A | 5/1991 | McLaughlin et al. |
| 5,054,610 | A | 10/1991 | Ajello |

(Continued)

FOREIGN PATENT DOCUMENTS

| | | | |
|---|---|---|---|
| EP | 223581 | A2 | 5/1987 |
| EP | 389418 | A1 | 9/1990 |

(Continued)

OTHER PUBLICATIONS

Innovative Kiosk Turnkey Solution for Automated inventory Management Delivers Results, Case Studies, CooperVision Incorporated, Feb. 12, 2009, http://www.ultimatetechnology.com/news-events-case-studies-details.php?id=14.

(Continued)

*Primary Examiner* — Patrick Mackey

(57) ABSTRACT

The present invention provides apparatus for dispensing ophthalmic lens packages. A plurality of ophthalmic lens packages are loaded into the apparatus and the apparatus determines an identity of each ophthalmic lens package. A housing stores the ophthalmic lens packages and records a location and identity of each of the lens packages and dispenses a particular ophthalmic lens package.

20 Claims, 11 Drawing Sheets

U.S. PATENT DOCUMENTS

| | | | | |
|---|---|---|---|---|
| 5,271,703 | A * | 12/1993 | Lindqvist et al. | 414/268 |
| 5,337,888 | A | 8/1994 | Morrison | |
| 5,375,698 | A | 12/1994 | Ewart et al. | |
| 5,379,229 | A | 1/1995 | Parsons et al. | |
| 5,409,104 | A | 4/1995 | Lovell | |
| 5,433,314 | A | 7/1995 | Lin | |
| 5,460,294 | A | 10/1995 | Williams | |
| 5,467,868 | A | 11/1995 | Abrams et al. | |
| 5,468,110 | A * | 11/1995 | McDonald et al. | 414/273 |
| 5,515,964 | A | 5/1996 | Bauman | |
| 5,573,108 | A | 11/1996 | Hamilton et al. | |
| 5,593,267 | A | 1/1997 | McDonald et al. | |
| 5,609,246 | A | 3/1997 | Borghorst et al. | |
| 5,620,087 | A | 4/1997 | Martin et al. | |
| 5,653,844 | A | 8/1997 | Abrams | |
| 5,656,362 | A | 8/1997 | Abrams | |
| 5,695,049 | A | 12/1997 | Bauman | |
| 5,697,495 | A | 12/1997 | Abrams et al. | |
| 5,704,468 | A | 1/1998 | Lust et al. | |
| 5,710,302 | A | 1/1998 | Kunzler et al. | |
| 5,711,416 | A | 1/1998 | Bauman | |
| 5,720,157 | A * | 2/1998 | Ross | 53/445 |
| 5,722,536 | A | 3/1998 | Pierce | |
| 5,760,100 | A | 6/1998 | Nicolson | |
| 5,776,999 | A | 7/1998 | Nicolson et al. | |
| 5,789,461 | A | 8/1998 | Nicolson | |
| 5,823,327 | A | 10/1998 | Wu | |
| 5,839,587 | A | 11/1998 | Gress | |
| 5,849,811 | A | 12/1998 | Nicolson | |
| 5,908,527 | A | 6/1999 | Abrams | |
| 5,915,545 | A | 6/1999 | Shackel | |
| 5,965,631 | A | 10/1999 | Nicolson | |
| 5,983,608 | A | 11/1999 | Wu | |
| 5,993,755 | A | 11/1999 | Andersen | |
| 5,998,498 | A | 12/1999 | Vanderlaan | |
| 6,003,006 | A | 12/1999 | Colella et al. | |
| 6,029,808 | A | 2/2000 | Peck | |
| 6,044,966 | A | 4/2000 | Haase | |
| 6,047,938 | A | 4/2000 | Mitchell | |
| 6,087,415 | A | 7/2000 | Vanderlaan | |
| 6,090,471 | A | 7/2000 | Abrams | |
| 6,161,696 | A | 12/2000 | Lashley | |
| 6,164,452 | A | 12/2000 | Ellis | |
| 6,208,908 | B1 * | 3/2001 | Boyd et al. | 700/216 |
| 6,244,430 | B1 | 6/2001 | Travis | |
| 6,253,912 | B1 | 7/2001 | O'Neill et al. | |
| 6,314,337 | B1 * | 11/2001 | Marcum | 700/216 |
| D458,023 | S | 6/2002 | Dzwill et al. | |
| 6,401,915 | B1 | 6/2002 | Faxe | |
| 6,474,465 | B1 | 11/2002 | Jux | |
| 6,522,939 | B1 * | 2/2003 | Strauch et al. | 700/116 |
| 6,882,982 | B2 | 4/2005 | McMenimen et al. | |
| 6,910,601 | B2 | 6/2005 | Thomas et al. | |
| 6,925,447 | B2 | 8/2005 | McMenimen et al. | |
| 7,072,737 | B2 | 7/2006 | Lunak et al. | |
| 7,086,526 | B2 | 8/2006 | Newman | |
| 7,194,333 | B2 * | 3/2007 | Shoenfeld | 700/243 |
| 2001/0017271 | A1 | 8/2001 | Yavitz | |
| 2002/0032620 | A1 | 3/2002 | Benz et al. | |
| 2002/0063068 | A1 | 5/2002 | Faxe | |
| 2002/0128957 | A1 | 9/2002 | Rosenberg et al. | |
| 2002/0175177 | A1 | 11/2002 | Jepson | |
| 2002/0197478 | A1 | 12/2002 | Muggli | |
| 2004/0004008 | A1 | 1/2004 | Peck | |
| 2004/0236607 | A1 | 11/2004 | Kost et al. | |
| 2004/0238380 | A1 | 12/2004 | Newman | |
| 2006/0126015 | A1 | 6/2006 | Legerton et al. | |
| 2008/0023345 | A1 | 1/2008 | Tokarski | |
| 2011/0054927 | A1 * | 3/2011 | Renna et al. | 705/2 |
| 2012/0016515 | A1 * | 1/2012 | Pfeiffer | 700/216 |

FOREIGN PATENT DOCUMENTS

| | | | |
|---|---|---|---|
| EP | 406161 | A2 | 1/1991 |
| EP | 734957 | A1 | 10/1996 |
| EP | 995688 | A1 | 4/2000 |
| EP | 1092645 | A1 | 4/2001 |
| EP | 1277416 | A2 | 1/2003 |
| GB | 884314 | A | 12/1961 |
| GB | 1311091 | A | 3/1973 |
| GB | 2328924 | A | 3/1999 |
| JP | 64017654 | | 1/1989 |
| JP | 10313928 | A | 12/1998 |
| JP | 2000016905 | A | 1/2000 |
| JP | 2001305495 | | 10/2001 |
| JP | 2002258222 | | 9/2002 |
| JP | 2008090472 | | 4/2008 |
| WO | WO 9104283 | A1 | 4/1991 |
| WO | WO 9421698 | A1 | 9/1994 |
| WO | WO 9718997 | A1 | 5/1997 |
| WO | WO 0022560 | A2 | 4/2000 |
| WO | WO 0022560 | A3 | 7/2000 |
| WO | WO 0076881 | A1 | 12/2000 |
| WO | WO 0022560 | A9 | 7/2001 |
| WO | WO 03016175 | A1 | 2/2003 |
| WO | WO 2004024573 | A2 | 3/2004 |
| WO | WO 2004026566 | A1 | 4/2004 |
| WO | WO 2004024573 | A3 | 5/2004 |
| WO | WO 2005025991 | A2 | 3/2005 |
| WO | WO 2005082721 | A2 | 9/2005 |
| WO | WO 2006060448 | A2 | 6/2006 |

OTHER PUBLICATIONS

PCT Search Report PCT/US2009/068211 dated May 11, 2010.

* cited by examiner

APPARATUS AND METHOD FOR DISTRIBUTING OPHTHALMIC LENSES

RELATED APPLICATIONS

This application claims the benefit of provisional applications, U.S. Ser. No. 61/171,593 filed on Apr. 22, 2009 and U.S. Ser. No. 61/141,714, filed on Dec. 31, 2008.

This invention relates to an apparatus for automatically loading, dispensing, and taking inventory of ophthalmic lenses

BACKGROUND

Due to advances in the design and cosmetic appearance of ophthalmic lenses the dispensers of such lenses need to maintain a large stock of such lenses to fit patients. In the trade theses lenses are commonly known as diagnostic lenses. For example when a patient suffers from astigmatism, an individual ophthalmologist may need to try several different prescriptions on a patient before the appropriate degree of vision correction is found. Given that space is limited in most dispenser's offices, maintaining sufficient quantities of different prescriptions is an administrative and logistical problem. Therefore it would be beneficial to have an apparatus that loads, stores, dispenses, keeps an inventory of a variety of different diagnostic lenses. This need and others are met by the following invention.

DETAILED DESCRIPTION OF THE INVENTION

This invention includes an apparatus for storing, and dispensing ophthalmic lens packages comprising

Figure 1:
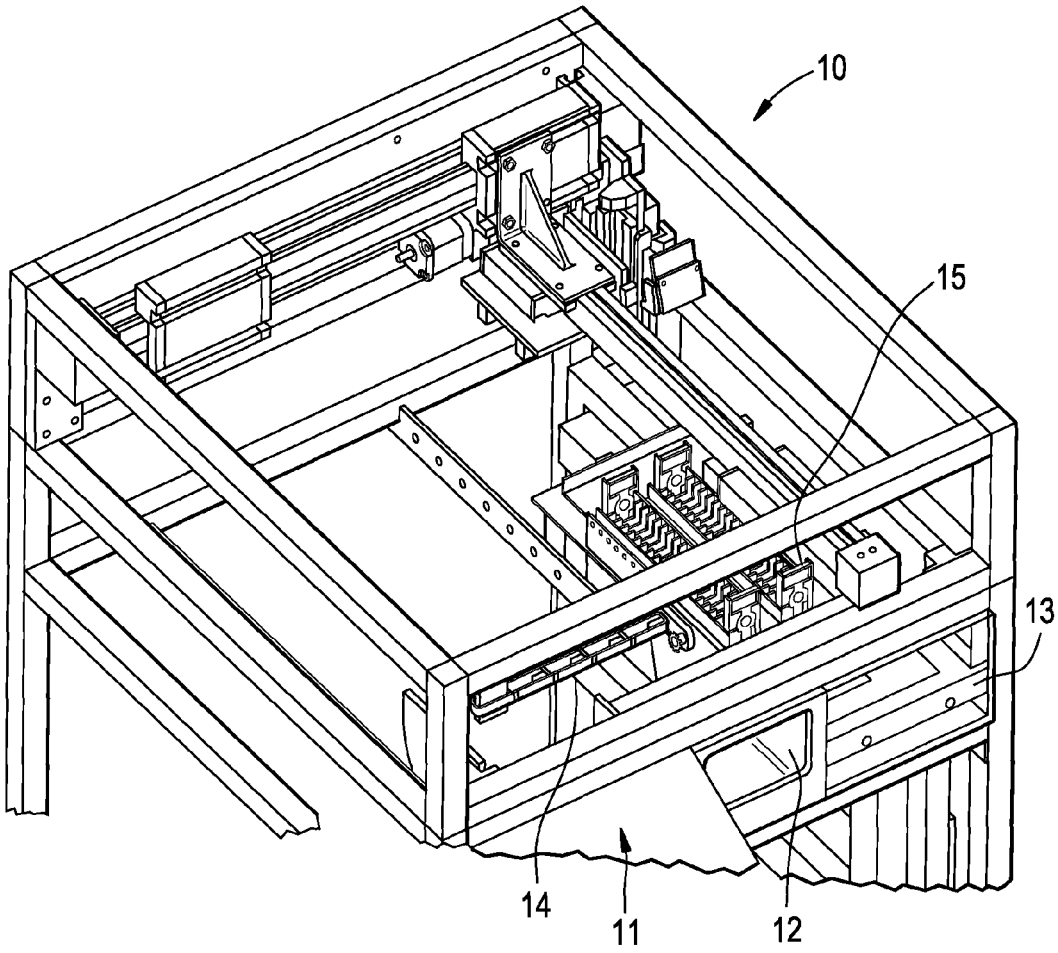
FIG. 1 Perspective view apparatus
FIG. 2 Perspective view tray
FIG. 3 Perspective view means for loading
FIG. 4 Perspective view housing
FIG. 5 Perspective view housing
FIG. 6 Perspective view alternative gripper designs
FIG. 7 Perspective view cartridge
FIG. 8 Perspective view package enclosed in a cartridge
FIG. 9 Perspective view of packages enclosed in a cartridge
FIG. 10 Flow chart process
FIG. 11 Flow chart process
Figure 2:
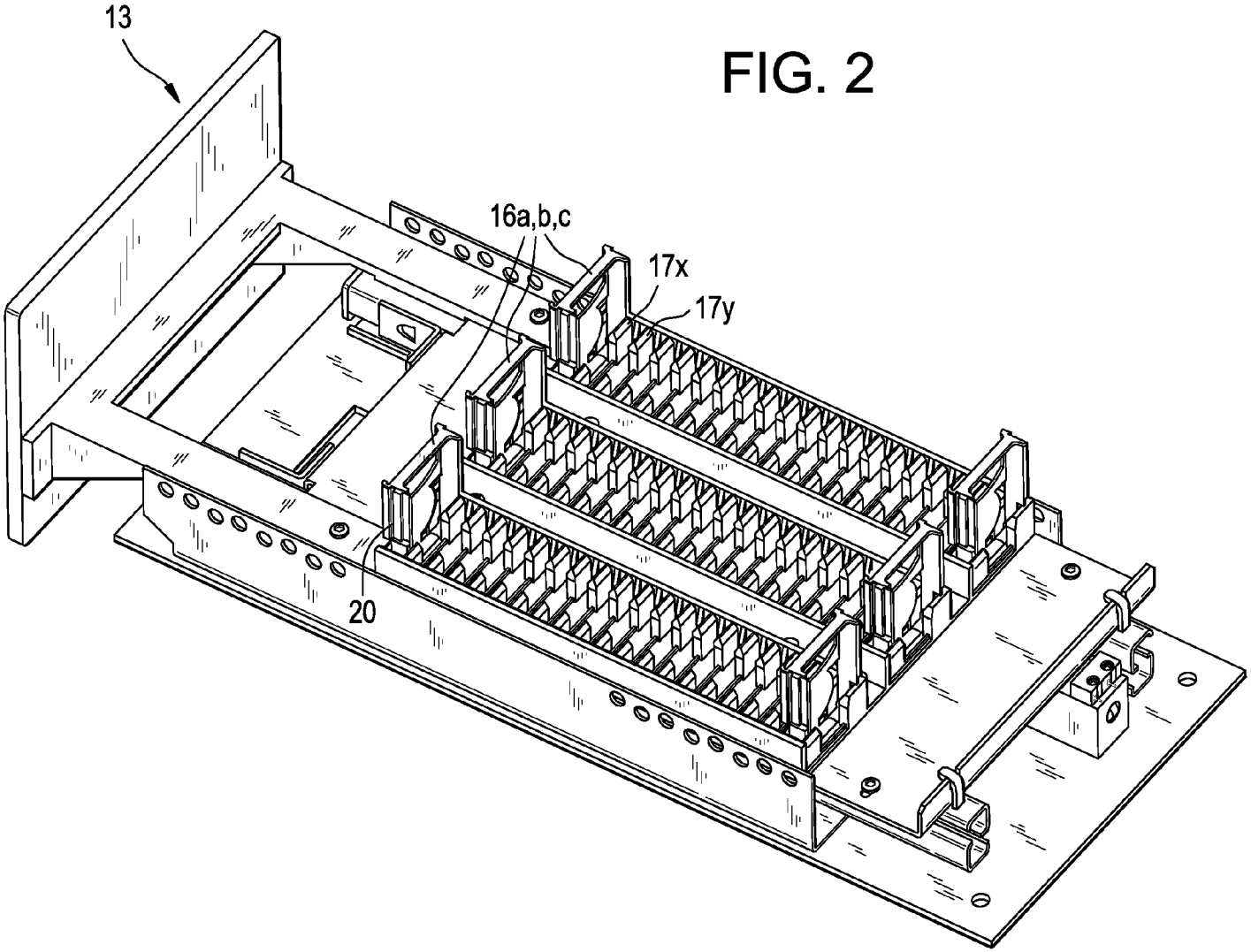

- a means for loading a plurality of ophthalmic lens packages
- a means for determining the identity of each of said ophthalmic lens packages
- a means for housing a plurality of ophthalmic lens packages
- a means for inserting at least one ophthalmic lens packages of said plurality of ophthalmic lens packages to said housing
- a means for recording the location and the identity of each of said ophthalmic lens packages in said housing
- a means for retrieving at least one ophthalmic lens package from said housing The invention is further described in further detail in reference an embodiment illustrated in FIGS. 1-5. FIG. 1 shows a perspective view of the apparatus 10 without side walls to enable one to view the interior of the apparatus. Keypad 11 permits a user to request a particular ophthalmic lens from the apparatus and dispensing orifice 12 permits the same user to retrieve ophthalmic lenses that are removed from the housing 14. Keypad 11 may be replaced by any device which allows a user to interface with the apparatus. A non-limiting list of such replacements includes but is not limited to touch screens, and push buttons with a display, and scroll wheel interface similar to IPOD devices. In FIG. 1 door 13 is attached to loading tray 15 and assists the user to slide tray 15 towards the exterior of apparatus 10 for loading. However door 13 may be attached to apparatus 10 via any means that permits the opening of door 13, such as hinges, spring loaders, magnetic clips and the like. FIG. 2 illustrates slide tray 15 with ophthalmic lens packages 16*a* 16*b*, and 16*c*. Tray 15 has three columns, a, b, and c containing stops 17*x* and 17*y*. to permit spacing between the ophthalmic lens packages and help to hold the packages to tray 15. In this embodiment the "means for loading a plurality of ophthalmic lens packages" includes tray 15, and this means is the preferred means.

Figure 3:
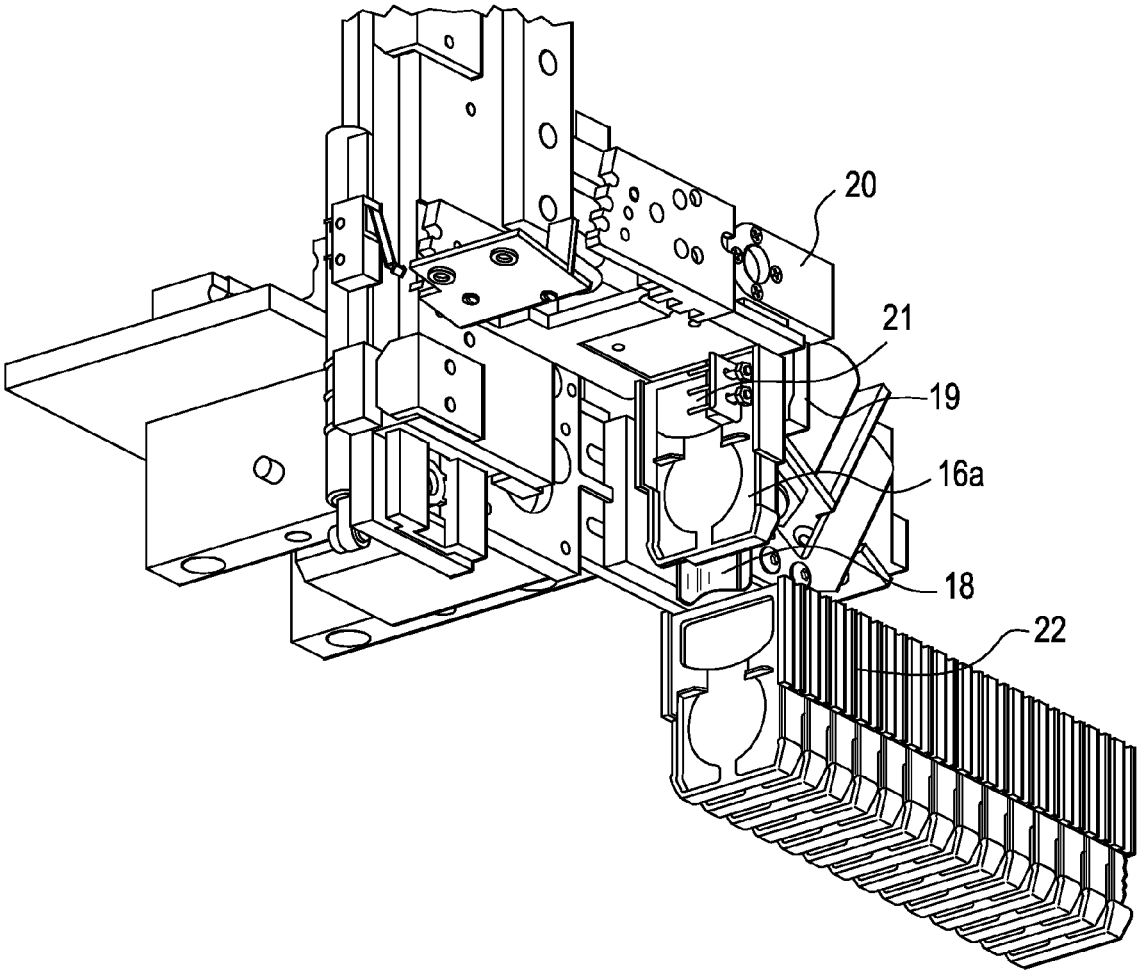

FIG. 3, is a side plan view of a number of packages, illustrated with hold down 18, gripper 19, motor 20, and bar code reader 21. A presence sensor and an XYZ-robot (each axis has it's own motor and control for motion on the axis—Z axis is vertical and the X and Y axes are horizontal) are attached to the gripper, but not illustrated. The packages are in the orientation in which they would be placed in tray 15, but the tray is removed for purposes of illustration. Each ophthalmic lens package is enclosed by an individual cartridge 22, described in further detail below. During the loading operation, the XYZ-robot moves the gripper to a location of tray 15 and the presence sensor checks that location to see an ophthalmic lens package is present. If a package is present a motor, other than motor 20, engages to press hold down 18 against the row of packages, while, gripper 19 lifts one package 16*a*, encased in cartridge 22, to be read by bar code reader 21. Alternatively the packages can be held down, so that only one is lifted by the gripper, using a stationary hold that is not controlled by a motor. Still further, each cartridge 22 which encloses package 16, is sized to fit snugly into tray 15 so that cartridge 22 cannot be removed from tray 15 without substantial force by gripper 19. In this case no holdown device is required to stop the lifting of packages other than the gripped package. The bar code reader correlates the bar code with any or all of the following information which includes but is not limited to the prescription, the lot number, manufacture's name, lens type, brand, time of manufacturing, the age of each package at the time of dispensing, and the expiration date of each ophthalmic lens package 16 (singularly or collectively the "identity" of each ophthalmic lens package). As used herein bar code reader 21 and the corresponding bar code on the package is a means for determining the identity of the ophthalmic lens package, and this means is the preferred means. This bar code may be affixed to the package or to the cartridge if used. Other means for determining the identity of the ophthalmic lens package include but are not limited to optical character recognition readers which read printed prescription information, radio frequency readers and tags, non-contact electromagnetic sensors, and memory chips that are incorporated into the apparatus of the invention.

Figure 6:
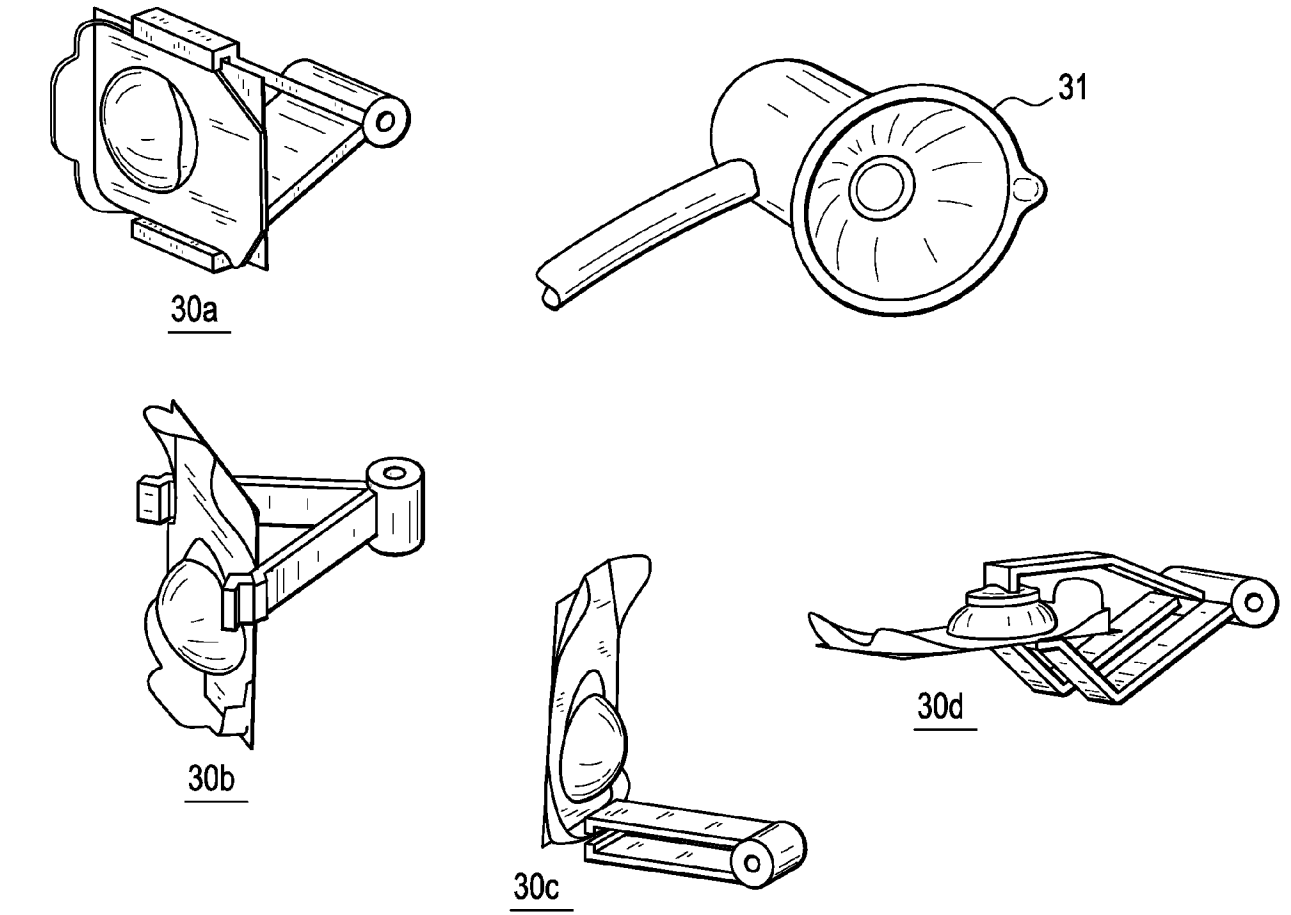

Once gripper 19 holds ophthalmic lens package 16 and cartridge 22, it moves the package and cartridge to housing 14 for insertion. In this embodiment the "means for inserting at least one ophthalmic lens package of said plurality of ophthalmic lens packages to said housing" includes a motor 20 and gripper 19, and this means is the preferred means. Other means for inserting at least one ophthalmic lens package of said plurality of ophthalmic lens packages to said housing include but are not limited to pinchers 30 (see FIG. 6. in four different positions a-d) and suction cups 31, for gripper 19 and, stepper motors, servo motors, DC motors, or solenoid driven actuators for motor 20.

Figure 4:
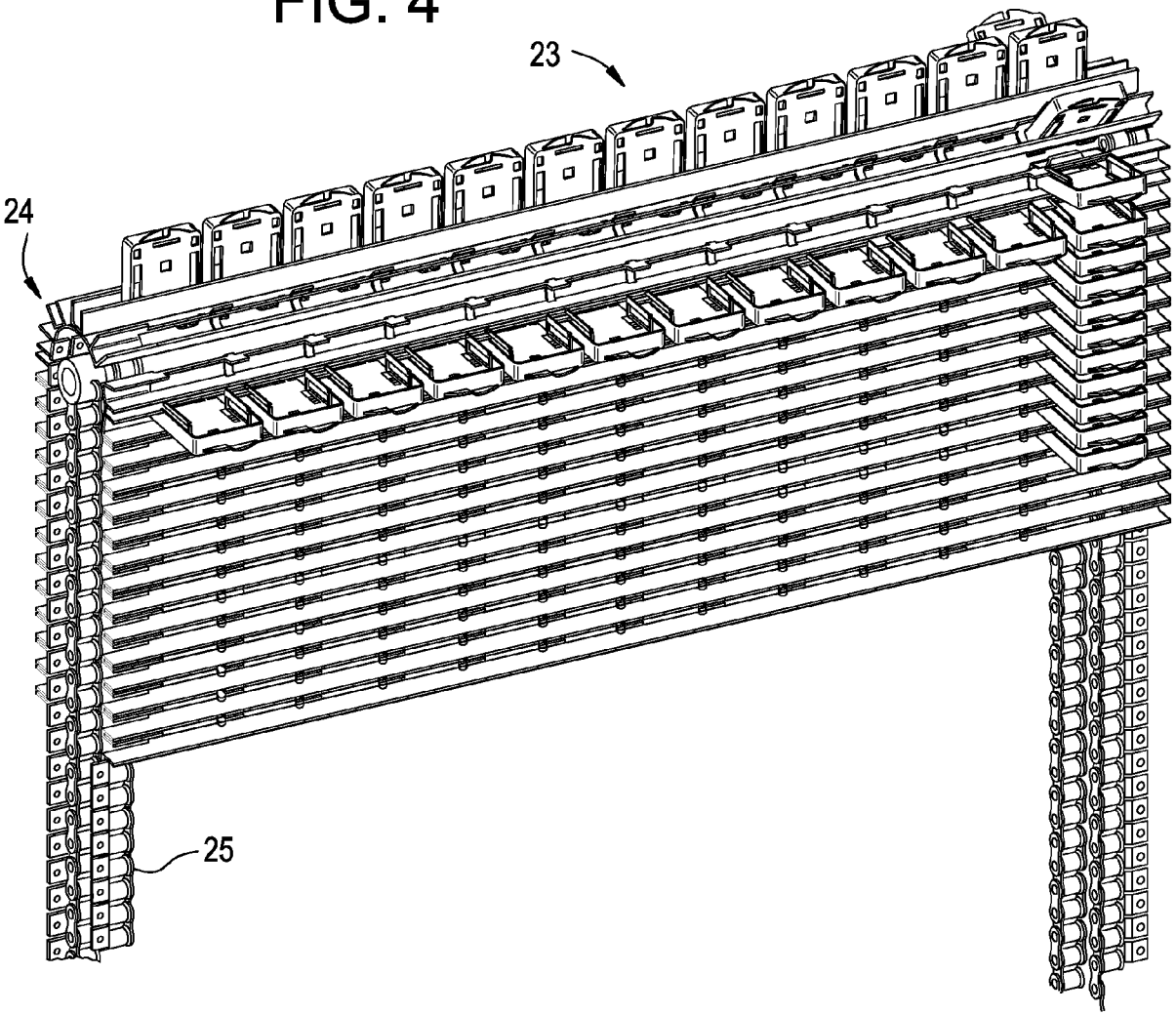
Figure 5:
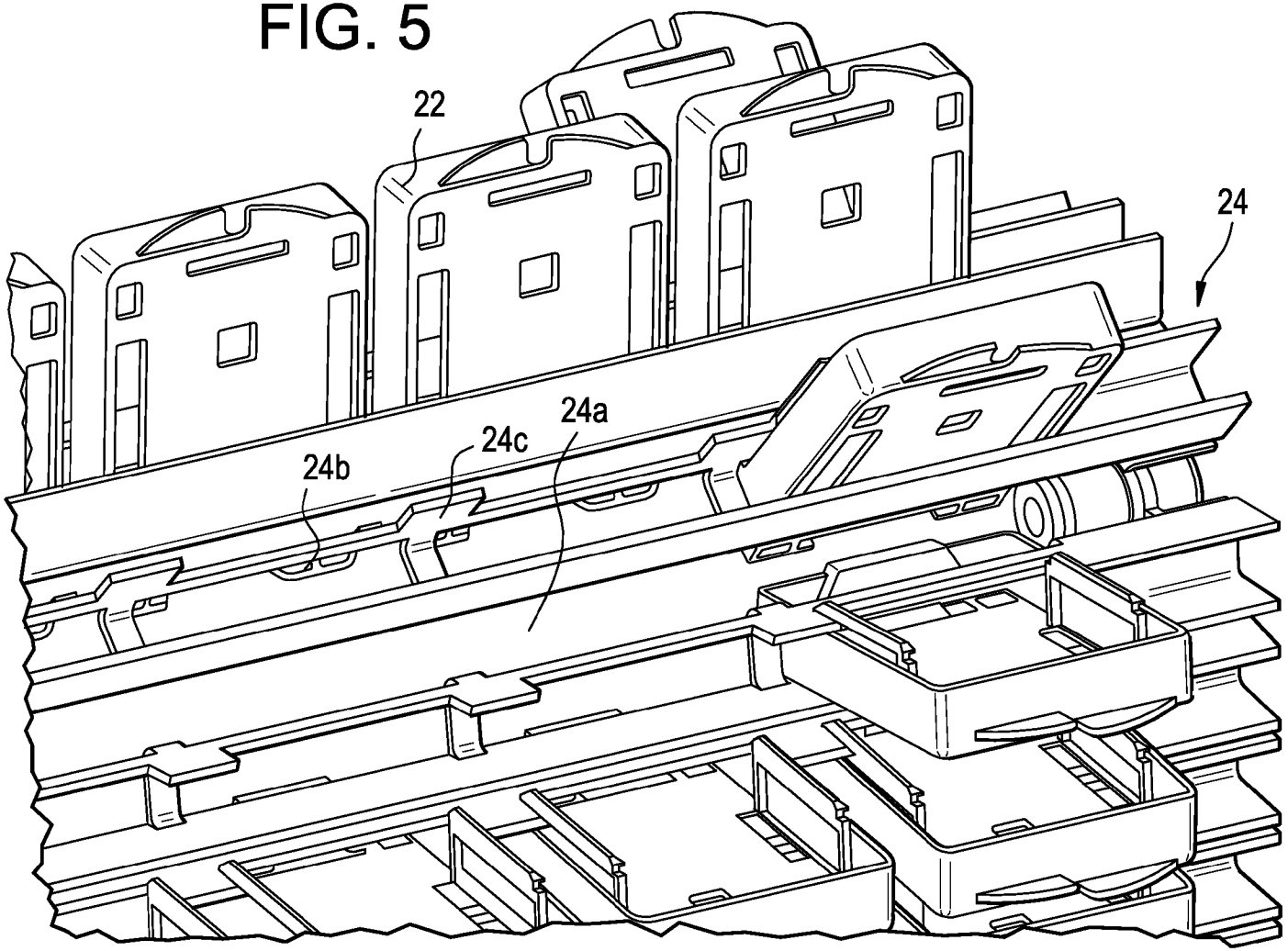

FIG. 4 illustrates a "means for housing a plurality of ophthalmic lens packages." Housing 14 has a number of channels 24 into which ophthalmic lens packages 16 (enclosed in cartridges 22) may be inserted parallel to the side walls of channel 24. Each of said channels is attached to a drive chain 25, which in turn is attached to a motor (not shown). During operation each channel rotates with drive chain 25 holding any ophthalmic lens packages stored in that channel during said rotation. Further detail of channels 24 is shown in FIG. 5. In this figure, channel walls 24*a* and 24*b*, where wall 24*a* is solid and wall 24*b* contains indentations, 24*c*. Indentations 24*c* are sized and have enough flexion to permit insertion cartridges 22 (or ophthalmic lens packages) into a location, hold the same during the rotation of drive chain 25, and permit removal of individual ophthalmic lens packages (enclosed in cartridges 22). Preferably, each of the locations within channel 24 are marked with some human readable marking to enable a user of the apparatus to locate the ophthalmic lens package when the apparatus is used in the manual mode discussed below. Housing 14 attached to chain drive 25 is the preferred means of housing a plurality of ophthalmic lens packages. Other such means include but are not limited to vertical, horizontal, or circular channels and vertical, horizontal or circular trays containing individual housings sized to accommodate an one or more ophthalmic lens packages.

Once gripper 19 moves the ophthalmic lens package towards housing 14 it inserts the ophthalmic lens package in a location in the housing. This location and the identity of the package are sent to a computer (incorporated in the apparatus and not shown or a remote computer at the manufacture's facility or some other location), which builds and maintains a database correlating the location of the package in the housing and the identity of said package. A computer that is incorporated in the apparatus is the preferred means for recording the location and the identity of each of said ophthalmic lens packages in said housing.

When a user wishes to retrieve a lens from apparatus 10, the user may enter the identity of the desired lens in keypad 11, which contains a processor, not shown, connected to the computer and its database. The computer notes the location of the desired ophthalmic lens package in the housing and in the case of housing 14, instructs drive chain 25 to bring the desired ophthalmic lens package (optionally enclosed in cartridge 22) to a position where it may be retrieved by gripper 19, as manipulated by motor 20 and the XYZ-robot. Optionally, the retrieved package (or cartridge enclosed package) may be scanned by bar code reader 21, to confirm its identity. In this embodiment, the means for retrieving at least one ophthalmic lens package from said housing is gripper 19, motor 20 and the XYZ-robot and this is the preferred means. Other such means include but are not limited pinchers 30 (see FIG. 6. in four different positions a-d) and suction cups 31, gripper and, stepper motors, servo motors DC motors, or solenoid driven actuators for motor 20. The means for retrieving deposits the ophthalmic lens package in a receptacle (not shown) where it can be retrieved by a user. Such receptacles include but are not limited to shoots, doors, trays, and other access points to the apparatus.

Figure 7:
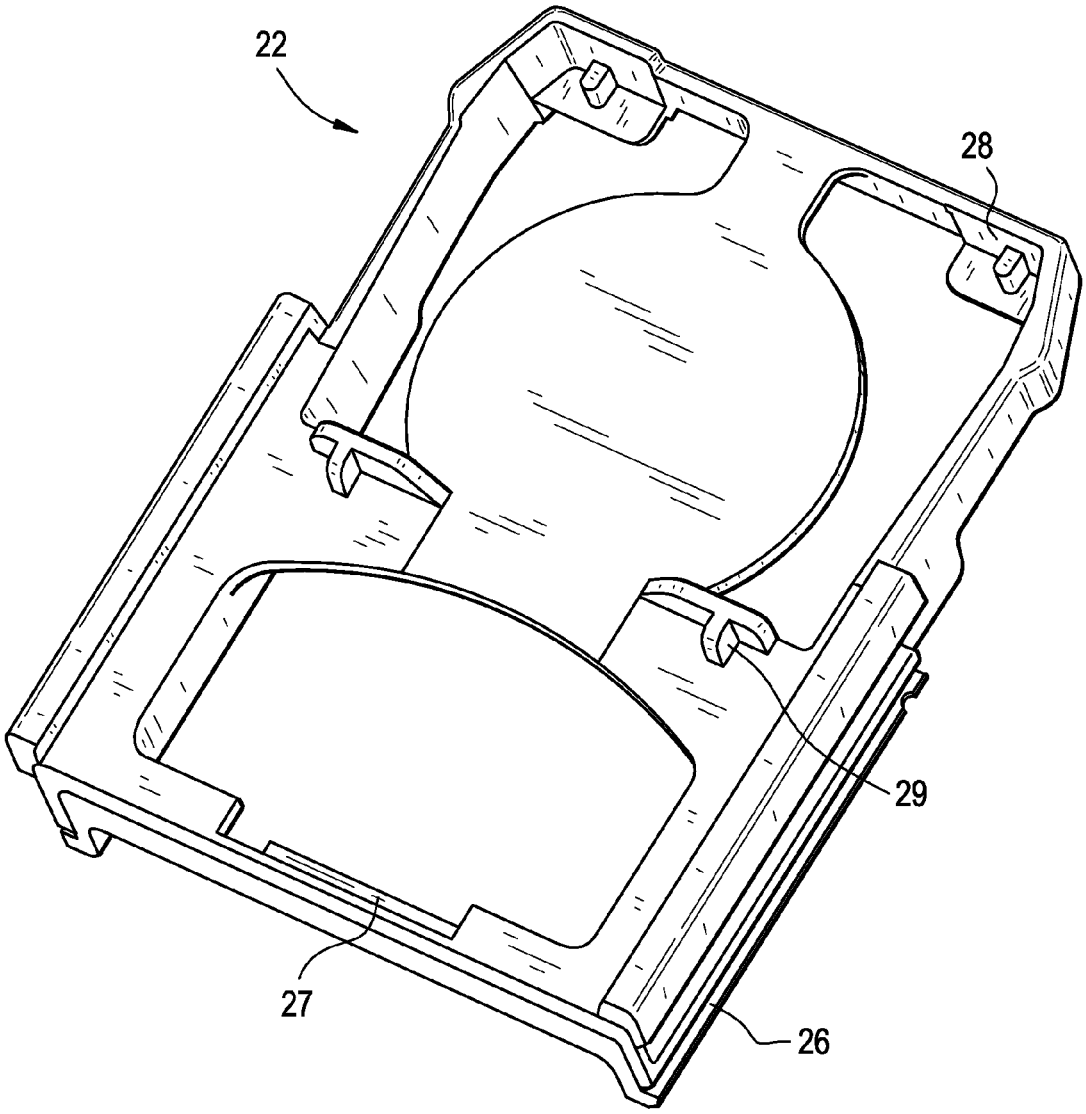
Figure 8:
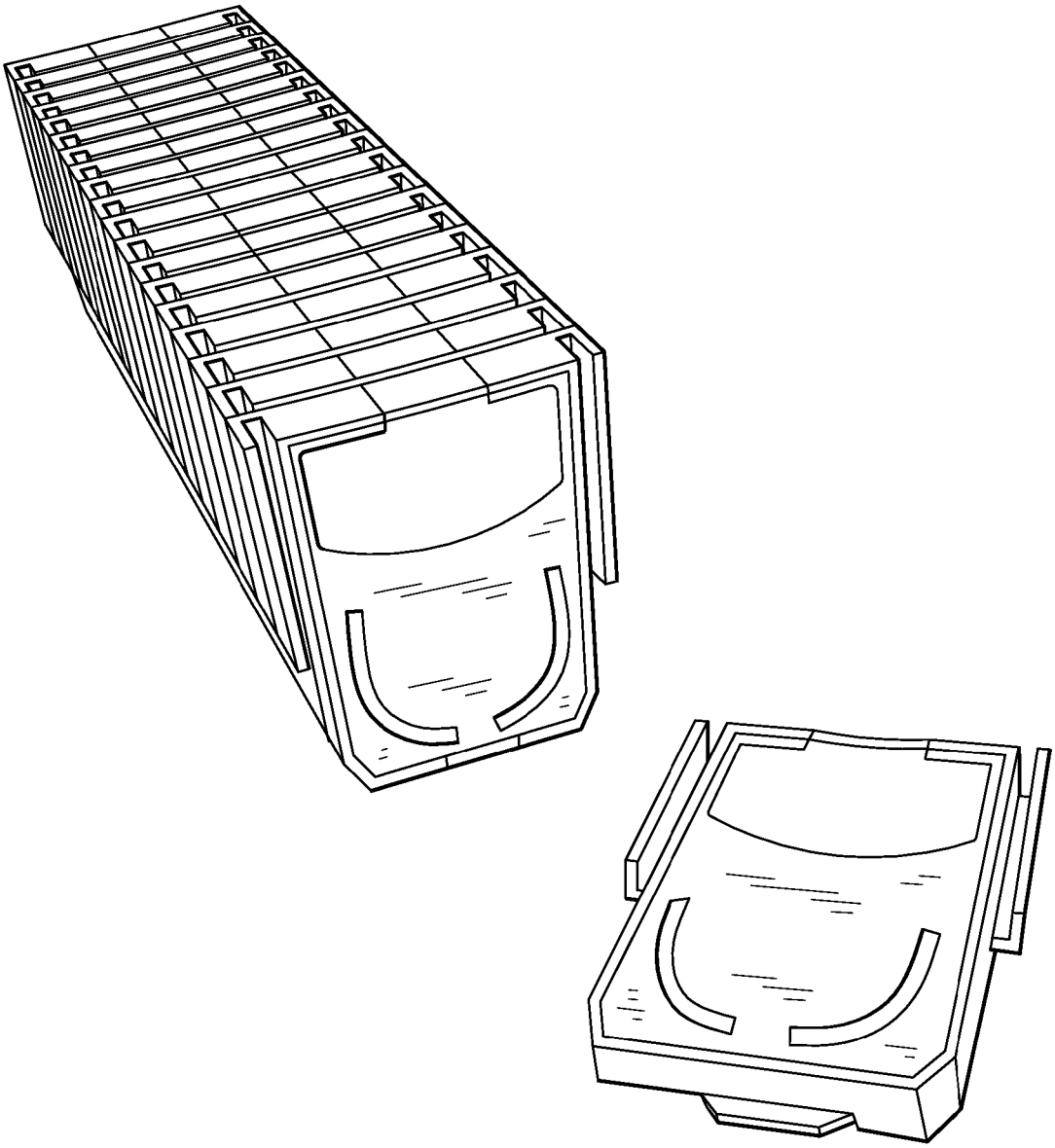

FIG. 7 illustrates cartridge 22. During operation of the apparatus, it was found that if individual ophthalmic lens packages were inserted in a cartridge that the ease of handling such packages was improved. Cartridge 22 has grooves 26 on opposing sides, stops 27 and 28 and tabs 29. As can be seen from FIG. 8 stops 27 and 28 hold the package snuggly and when cartridge 22 is manually flexed by the user the ophthalmic lens package may be inserted or removed from cartridge 22. Grooves 26 permit individual cartridges to be stacked together as one. Tabs 29 provide a hold for the gripper to lift the ophthalmic lens package from a stack of such packages. This stacking of cartridges is illustrated in FIG. 8.

Figure 9:
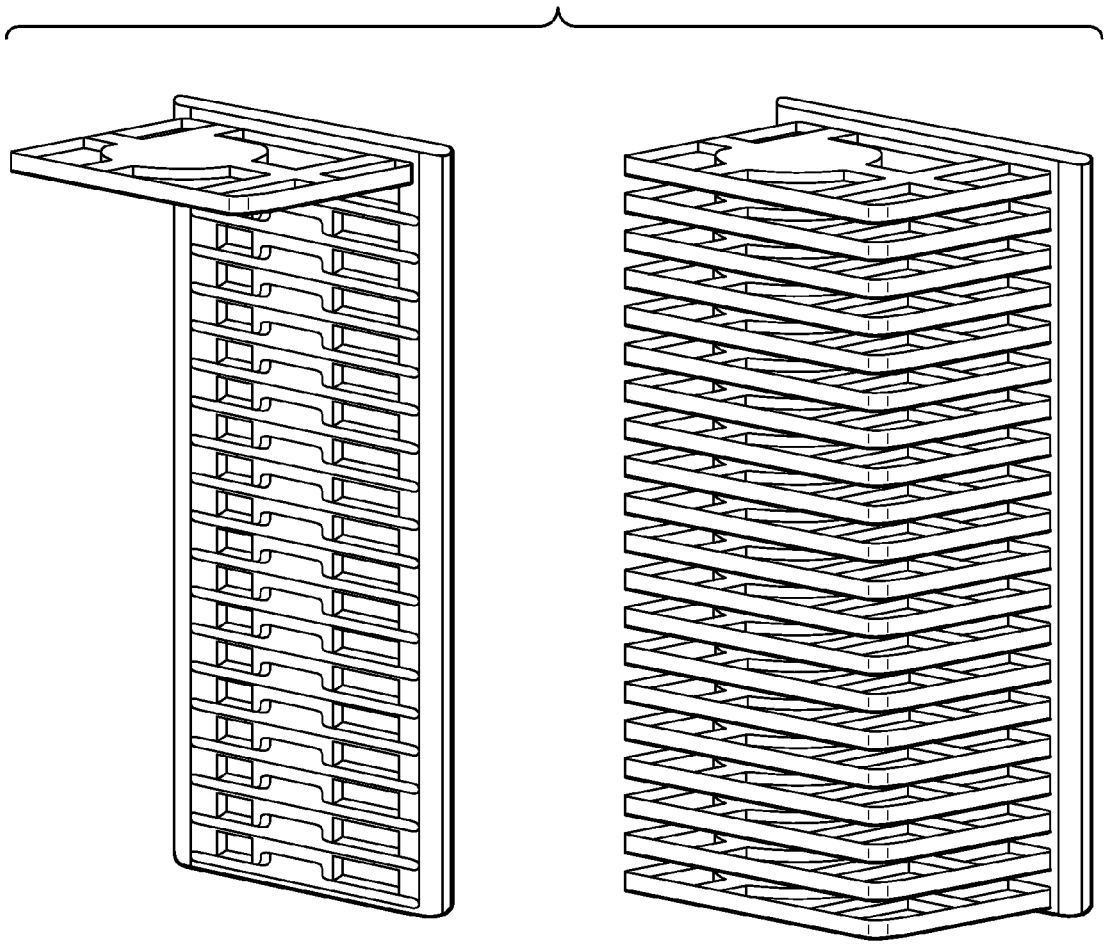

Yet still further the invention includes a cartridge for enclosing an ophthalmic lens package comprising, a flexible means for holding the package until a user removes it. As used herein said flexible means for holding the package includes but is not limited to any of all, stops, plates, ribs and walls. Such cartridges may be made of polymers, metal nylon, rubber, or paper. It is preferred that the cartridges are made of polymers, nylon or rubber. In the preferred cartridges of the invention, the cartridges further comprise any or all of the following interconnecting grooves, pins or hooks, which permit the cartridges to be connected to each other plates to protect the product from accidental protrusion or puncture, and ribs to provide orientation. The most preferred cartridges comprise grooves, ribs and plates. Two advantages of the cartridge are protecting the package from being damaged by the apparatus and maintaining orientation package to enable consistent presentment to the mechanisms of the apparatus. Preferably each cartridge holds one ophthalmic lens package, however, the cartridge may be sized to hold multiple ophthalmic lens packages may be enclosed in a single cartridge, as illustrated by FIG. 9

Figure 10:
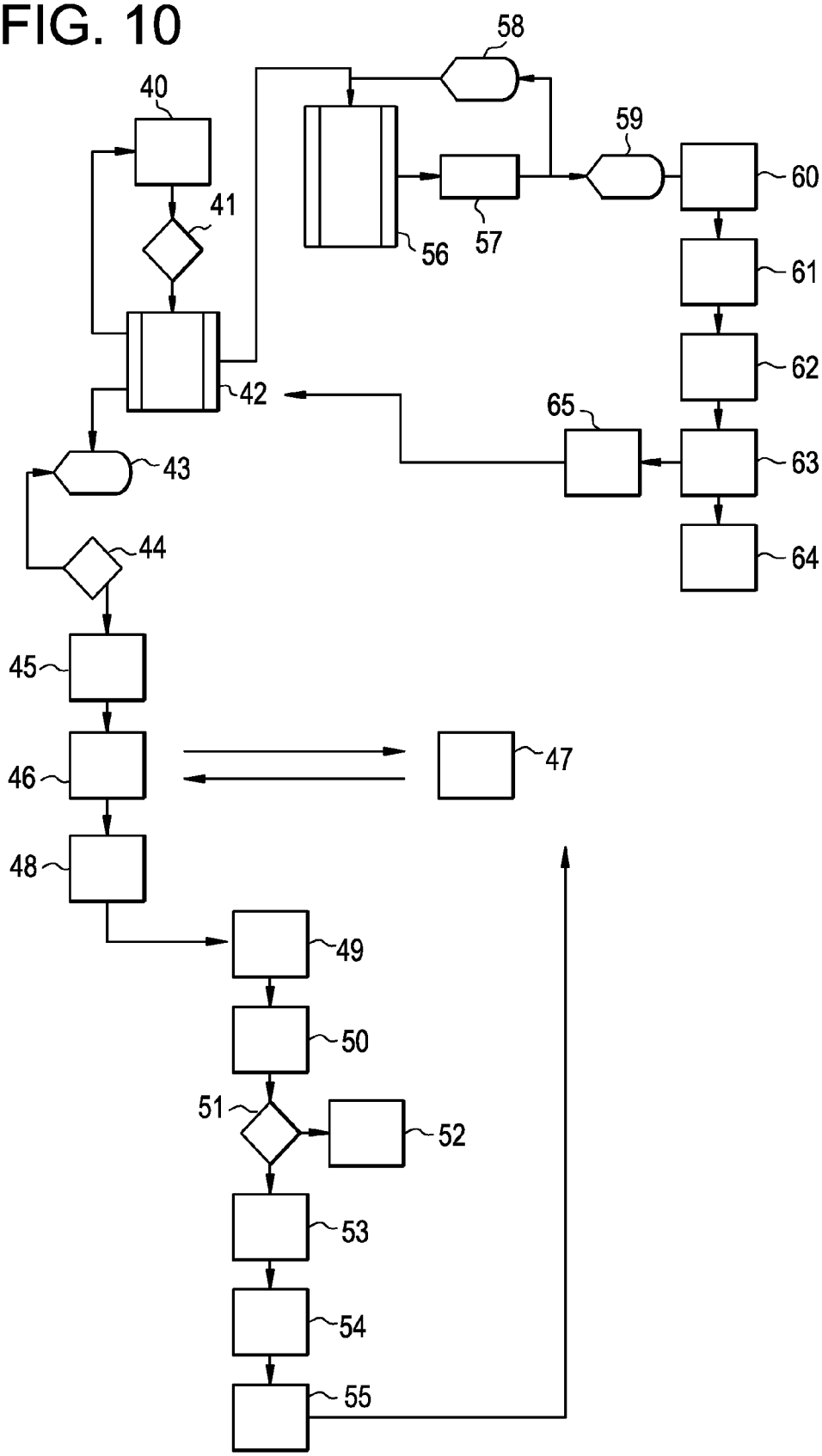
Figure 11:
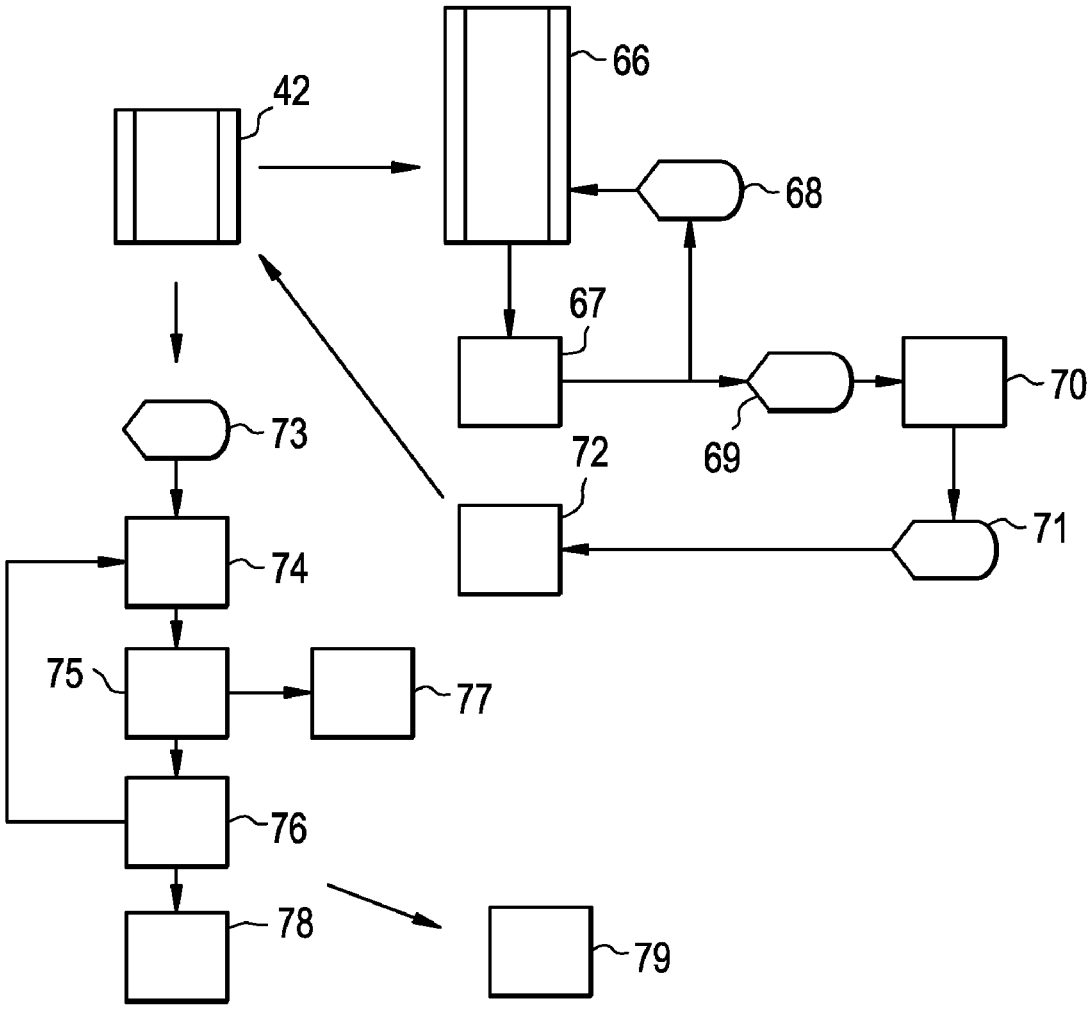

Software control the functions of the apparatus of and the flow chart for the software of the illustrated embodiment follows in FIGS. 10 and 11. Step 40 presents a home screen on a display attached to keypad 11. Step 41 optionally requests a user to enter a password or other authorization information. If the user provides the incorrect information or takes to long to provide this information, the home screen will return. If the correct information is provided step 42 displays the Main Menu. This menu allows the user to select from the following functions (a) loading ophthalmic lenses to the apparatus, (b) dispensing ophthalmic lenses, (c) manually retrieving ophthalmic lenses (d) displaying the mechanical status of the machine, (e) taking an inventory of the ophthalmic lenses in the apparatus, (f) reviewing the identity of products available in the machine, (g) initiating the machine to take an inventory of the available products, or (h) reordering dispensed ophthalmic lenses from the manufacturer (or distributor).

If loading is selected step 43 displays loading instructions on the screen and door 13 unlocks to permit the user access to tray 15. The user places at least one ophthalmic lens package 16 (optionally enclosed in cartridge 22) in tray 15. In the preferred apparatus of the invention accepts loading of ophthalmic lens packages 16 enclosed in cartridges 22. In addition the preferred apparatus accepts a random assembly of ophthalmic lens packages 16. A "random assembly" means a variety of different ophthalmic lenses having different identities presented to the apparatus in no particular order. Typically a random assembly will contain about 2 individual ophthalmic lens packages to about 200, preferably about 2 to about 60 individual ophthalmic lens packages. In addition, the random assembly typically contains individual ophthalmic lens packages have about 2 to about 199, different identities, preferably about 2 to about 59 different identities. For the stack of packages of FIG. 8 contains as many different identities of ophthalmic lens packages as there are packages in the stack.

Once the ophthalmic lens packages are loaded to tray 15, tray 15 is reinserted and door 13 is closed during step 44. Gripper 19 is moved by the XYZ-robot to the start position of tray 15 during step 45. The presence sensor determines if an ophthalmic lens package is present in this location during step 46. If a package is present, gripper 19 moves it to the housing in during step 48, otherwise, gripper 19 moves to another position on tray 15 during step 47 and the sensor determine if an ophthalmic lens is present in that location during step 46. Steps 47 and 46 will continue until all of the locations in tray 15 have been searched and any found packages moved to housing 14. To pick up an ophthalmic lens package during step 48, motor 20 engages gripper 19 to retract one ophthalmic lens package during step 48. The identity of the ophthalmic lens package is determined by scanning it during step 49 and the apparatuses database is queried to find an empty location in housing 14 during step 50. If an empty location is found, step 51 instructs chain drive 25 and the XYZ-robot to place the open section of housing 14 close to gripper 19. If there are no open sections in housing 14, the database displays a message on the screen in step to the user during step 52. Alternatively, commonly used identities may be places in particular locations in the housing to facilitate easy retrieval during the manual mode of operation discussed below.

Step 53 instructs gripper 19 to insert the ophthalmic lens package in the open section and step 54 updates the database with the identity and location of the ophthalmic lens package. Gripper 19 is moved by the XYZ-robot to detect the subsequent package on tray 15 during step 55 and another ophthalmic lens package may be inserted to the housing. Alternatively, if the machine is dispensing an ophthalmic lens package, package may be loaded to tray 15, they may remain in the tray until the dispensing task is completed.

To dispense ophthalmic lens packages from the apparatus, the user selects the dispensing function from the main menu of step 42. Step 56 displays the dispensing screen to the user and the user inputs the identity of the desired ophthalmic lens package. A query is sent to the database in step 57 and if the requested lens is not found in the database, step 58 displays a message for the user noting that the requested lens is not available and recommending alternative lenses which are in the inventory. If the requested lens is found in the database, the process goes to step 59, where the location or locations of the requested lenses are found. Step 60 identifies the ophthalmic lens package with the earliest expiration date and sends a signal to the XYZ-robot, which controls gripper 19. Gripper 19 moves, to location near housing 14, and chain drive 25 rotates to bring the location of the requested ophthalmic lens package near to gripper 19. In step 61 gripper 19 picks up the requested package and in step 62 this piece is scanned to confirm its identity. Alternatively the scanner 21 scans the package before gripper 19 picks up the piece. If the identity is correct, gripper 19 takes the piece to the dispensing orifice for retrieval by the user during step 63. If the identity is not correct gripper 19 removes the incorrect piece during step 64 and places it in tray 15, so that it may be reloaded at a later time during step 65.

In order to manually retrieve the ophthalmic lens package the user selects manual access during step 42 and enters the identity of the requested ophthalmic lens package in step 66. The database is queried in step 67 and if the ophthalmic lens package is not found, the user is notified in step 68. If the ophthalmic lens package is found the location of package in the housing is displayed in step 69. The computer disables the XYZ-robot, drive chain 25 and other apparatus driven motors mechanisms and unlocks the side panel access door to the housing in step 70. The user may now open the side panel access door and manually move chain drive 25 to the location (as marked on the location) of the requested lens. When the user finishes, and closes the side panel access door, the user engages the program and notifies the program that the requested ophthalmic lens package was removed during step 71. Step 72 locks the side panel access door and returns to the main menu.

In order to take inventory of all of the identity and location of all ophthalmic lens packages in the housing the user selects inventory in step 42. Under the control of the XYZ-robot, scanner 21 advance to housing 14 during step 73. The scanner 21 determines the identity of the ophthalmic lens in the housing location during step 74, and correlates this information against the database in step 75. If the wrong lens is in the location, the database is corrected in step 77. If the correct lens is in the location the database is maintained as is in step 76. Scanner 21 moves to another location in the housing and steps 74 to 76 are repeated until all locations of the housing are evaluated.__ Step 78 informs the user when the inventory process is complete. In addition, step 79 may send the results of the inventory electronically (via hardwire, wireless, internet, or phone connection) to the manufacturer, in order to facilitate ordering of the lenses or optimize the placement of the lenses in the housing.

As used herein ophthalmic lens packages include but are not limited to receptacle portion (commonly known as a blister bowl) and a cover that is sealed to the blister bowl that are used to house an individual ophthalmic lens. Examples of suitably shaped blister bowls are disclosed in the following documents which are hereby incorporated by reference in their entirety, U.S. Pat. Nos. D 458,023; 4,691,820; 5,054,610; 5,337,888; 5,375,698; 5,409,104; 5,467,868; 5,515,964; 5,609,246; 5,695,049; 5,697,495; 5,704,468; 5,711,416; 5,722,536; 5,573,108; 5,823,327; 5,704,468; 5,983,608; 6,029,808; 6,044,966; and 6,401,915. The receptacle portion of some ophthalmic lens packages is not bowl shaped. For purposes of this invention, the receptacles of those packages are included in the term blister bowl. Examples of such packages include but are not limited to ophthalmic lens packages disclosed in WO 2005/082721, U.S. Pat. No. 7,086,526, WO 03/016175, US 2004/0238380, and US 2008/0023345 which are hereby incorporated by reference in their entirety. Preferably, the cover is a flexible sheets made from adhesive laminates of an aluminum foil and extruded or co-extruded polymer film that can be sealed to the top surface of the blister bowl in order to form a hermetic seal for the ophthalmic lens. Examples of such materials are disclosed in the following publications, U.S. Pat. Pub. No. 2002/0197478; U.S. Pat Nos. 6,090,471; 5,908,527; 5,656,362; 5,653,844; and 5,620,087, which are hereby incorporated by reference in their entirety.

As used herein "ophthalmic lens" refers to a device that resides in or on the eye. These devices can provide optical correction or may be cosmetic. Ophthalmic lenses include but are not limited to soft contact lenses, hard contact lenses, intraocular lenses or punctual plugs. The preferred lenses of the invention are soft contact lenses are made from hydrogels and silicone elastomers, which include but are not limited to silicone hydrogels, and fluorohydrogels, particularly when such lenses are used are bifocal lenses, toric lenses, or other forms of custom lenses. Soft contact lens formulations are disclosed in U.S. Pat. No. 5,710,302, WO 9421698, EP 406161, JP 2000016905, U.S. Pat. No. 5,998,498, U.S. Pat. No. 6,087,415, U.S. Pat. No. 5,760,100, U.S. Pat. No. 5,776,999, U.S. Pat. No. 5,789,461, U.S. Pat. No. 5,849,811, and U.S. Pat. No. 5,965,631. The foregoing references are hereby incorporated by reference in their entirety. The particularly preferred ophthalmic lenses of the inventions are know by the United States Approved Names of etafilcon A, genfilcon A, lenefilcon A, lotrafilcon A, lotrafilcon B, balafilcon A, polymacon, bafilcon, acofilcon A acquafilcon A, alofilcon A alphafilcon A, amifilcon A, astifilcon A, atalafilcon A, bisfilcon A bufilcon A, crofilcon A, cyclofilcon A, darfilcon A deltafilcon A, deltafilcon B, dimefilcon A, drooxifilcon A, epsifilcon A, esterifilcon A, focofilcon A, galyfilcon A, govafilcon A, hefilcon A hefilcon B, hefilcon D, hilafilcon A, hilafilcon B, hixoifilcon A, hioxifilcon B, hioxifilcon C, hydrofilcon A, lenefilcon A, licryfilcon A, licryfilcon B, lidofilcon B, lidofilcon A, mafilcon A, mesifilcon A, methafilcon B, mipafilcon A, narafilcon A, nelfilcon A, netrafilcon A, ocufilcon A, ocufilcon B, ocufilcon C, ocufilcon D, ocufilcon E, ofilcon A, omafilcon A, oxyfilcon A, pentafilcon A, perfilcon A, pevafilcon A, phemfilcon A, senofilcon A, silafilcon A, siloxyfilcon A, tefilcon A, tetrafilcon A, trifilcon A, vifilcon A, or xylofilcon A. More particularly preferred ophthalmic lenses of the invention are genfilcon A, lenefilcon A, lotrafilcon A, lotrafilcon B, or balafilcon A. The most preferred lenses include but are not limited to galyfilcon, senofilcon A, etafilcon A, nelfilcon A, hilafilcon, and polymacon. The apparatus of the invention is used to store and dispense both diagnostic lenses and revenue lenses, and it is preferred that the apparatus is used to store and dispense diagnostic lenses.

Further this invention includes an apparatus for storing, and dispensing ophthalmic lens packages comprising a means for loading a plurality of ophthalmic lens packages a means for providing the identity of each of said ophthalmic lens packages a means for housing a plurality of ophthalmic lens packages a means for inserting at least one ophthalmic lens packages of said plurality of ophthalmic lens packages to said housing a means for recording the location and the identity of each of said ophthalmic lens packages in said housing a means for retrieving at least one ophthalmic lens package from said housing As used herein the terms "means for loading" means for housing," "means for inserting," "means for recording the location and identity," and "means for retrieving" all have their aforementioned meanings and preferred ranges. The term "means for providing the identity" refers to a device used to input the identity of each of the ophthalmic lens packages into the apparatus by a user. This means is distinct from the means for determining the identity discussed above because that means is incorporated in the apparatus and the means for providing the identity is not. Examples for means for providing the identity include but are not limited to, a computer disc, a list of bar codes, a memory stick or another electronic signal into which the identity of each ophthalmic lens package has been placed.

For example a user could manually enter the identity of an ophthalmic lens package to the database via keypad 11 prior to loading the ophthalmic lens package into tray 15. The manufacturer of the lenses could send a random assortment of ophthalmic lens packages, enclosed in interconnecting cartridges to the doctor's office with a packaging slip. The packaging slip would list the identity of each of the random assortment in the order in which they are stacked together. The doctor's office could use a hand held scanner to read the invoice and transmit the information via hardwire connection or wirelessly to the apparatuses' computer. Alternatively, the manufacture could transmit this information wirelessly to the doctor's office when the stack of packages is placed into tray 15.

Still further the invention includes a method of storing, and dispensing ophthalmic lens packages comprising storing, dispensing and such packages in an apparatus comprising a means for loading a plurality of ophthalmic lens packages a means for determining the identity of each of said ophthalmic lens packages a means for housing a plurality of ophthalmic lens packages a means for inserting at least one ophthalmic lens packages of said plurality of ophthalmic lens packages to said housing a means for recording the location and the identity of each of said ophthalmic lens packages in said housing a means for retrieving at least one ophthalmic lens package from said housing As used herein the terms "means for loading" means for housing," "means for inserting," "means for determining the identity," "means for recording the location and identity," and "means for retrieving" all have their aforementioned meanings and preferred ranges.

Yet still further, the invention includes a method of storing, and dispensing ophthalmic lens packages comprising storing, dispensing and such packages in an apparatus comprising a means for loading a plurality of ophthalmic lens packages a means for providing the identity of each of said ophthalmic lens packages a means for housing a plurality of ophthalmic lens packages a means for inserting at least one ophthalmic lens packages of said plurality of ophthalmic lens packages to said housing a means for recording the location and the identity of each of said ophthalmic lens packages in said housing a means for retrieving at least one ophthalmic lens package from said housing As used herein the terms "means for loading" means for housing," "means for inserting," "providing the identity," "means for recording the location and identity," and "means for retrieving" all have their aforementioned meanings and preferred ranges.

The advantages of the invention are many. The preferred apparatuses and methods of this invention load anywhere from about 2 to about 200 ophthalmic lens packages to the apparatus in about 2 to about 60 seconds. The preferred apparatuses and methods of this invention insert an individual ophthalmic lens package to the housing from a random assembly of such packages in about 10 seconds to about 30 seconds per package. Further, the apparatuses and methods of the invention retrieve an individual ophthalmic lens package from the housing in about 5 seconds to 30 about seconds. The device allows for the storage of a large number of ophthalmic lens packages (preferably about 20 to about thousands, more preferably about 50 to about 30,000, most preferably about 1000 to about 8000) in a small space and provides the eyecare professionals easy access to such lenses and quick replenishment of used lenses through automatic inventory and ordering processes. Due to the apparatuses and methods of this invention, the timing of inserting and retrieving such ophthalmic lens packages is substantially independent of the number and the variety of ophthalmic packages loaded to the apparatus and stored in the housing, such that a user would not notice the difference. Still further advantages of the invention include, the ability to track which lenses are dispensed at a particular time at a particular location, and to deliver such information to the manufacturer. Further the apparatus may be fitted with a printer to directly print encrypted or unencrypted product identity and patient's contact information for mailing or other types of delivery to the patient. Still further, the apparatus can be placed in a retail establishment and so that patients as well as ophthalmic practitioners may use the apparatus to dispense ophthalmic lenses. Yet further still, to increase the storage and dispensing capacity one or more apparatuses may be coupled together.

The aforementioned embodiments of the invention are meant to illustrate the invention and suggest methods and devices that embody the invention. In addition to the embodiments enclosed herein, U.S. Ser. No. 61/141,714, filed on Dec. 31, 2008 and its non-provisional counterpart filed on Dec. 16, 2009, which are both incorporated by reference for the disclosures contained therein, contain embodiments of certain aspects of this invention. Those knowledgeable in the production three-dimensional objects as well as other specialties may find other methods of practicing the invention. However, those methods are deemed to be within the scope of this invention.

What is claimed is:

1. An apparatus for storing, and dispensing ophthalmic lens packages comprising a means for loading a plurality of ophthalmic lens packages a means for determining the identity of each of said ophthalmic lens packages a means for housing a plurality of ophthalmic lens packages a means for inserting at least one ophthalmic lens packages of said plurality of ophthalmic lens packages to said housing a means for recording the location and the identity of each of said ophthalmic lens packages in said housing a means for retrieving at least one ophthalmic lens package from said housing.

2. The apparatus of claim 1 wherein said apparatus loads a random assembly of about 2 to about 200 ophthalmic lens packages of about 2 to about 199 different identities.

3. The apparatus of claim 2 wherein the apparatus loads said random assembly in about 2 seconds to about 60 seconds.

4. The apparatus of claim 1 wherein the apparatus of the invention inserts an individual ophthalmic lens package to said housing from a random assembly of such packages in about to 10 seconds to about 30 seconds.

5. The apparatus of claim 1 wherein the apparatus retrieves an individual ophthalmic lens package in about 5 seconds to about 30 seconds.

6. The apparatus of claim 1 wherein the means for inserting comprises a gripper and a motor.

7. The apparatus of claim 1 wherein the means for determining the identity of each of said ophthalmic lens packages is selected from the group consisting of bar code readers, optical character recognition readers, radio frequency readers and tags, non-contact electromagnetic sensors, and memory chips.

8. The apparatus of claim 1 wherein the means for housing comprises channels attached to a drive chain.

9. The apparatus of claim 1 comprising about 15 to about 30,000 ophthalmic lens packages.

10. The apparatus of claim 1 further comprising about 200 to about 8000 ophthalmic lens packages.

11. The apparatus of claim 1 wherein each of said ophthalmic lens packages is enclosed in a cartridge.

12. An apparatus for storing, and dispensing ophthalmic lens packages comprising a means for loading a plurality of ophthalmic lens packages a means for providing the identity of each of said ophthalmic lens packages a means for housing a plurality of ophthalmic lens packages a means for inserting at least one ophthalmic lens packages of said plurality of ophthalmic lens packages to said housing a means for recording the location and the identity of each of said ophthalmic lens packages in said housing a means for retrieving at least one ophthalmic lens package from said housing.

13. The apparatus of claim 12 wherein the means for providing the identity of each of said ophthalmic lens packages is selected from the group consisting of a computer disc, a memory stick, and a list of bar codes.

14. The apparatus of claim 12 wherein said apparatus loads a random assembly of about 2 to about 200 ophthalmic lens packages of about 2 to about 199 different identities.

15. The apparatus of claim 14 wherein the apparatus loads said random assembly in about 2 seconds to about 10 seconds.

16. The apparatus of claim 12 wherein the apparatus of the invention inserts an individual ophthalmic lens package to said housing from a random assembly of such packages in about to 10 seconds to about 30 seconds.

17. The apparatus of claim 12 wherein the apparatus retrieves an individual ophthalmic lens package in about 5 seconds to about 30 seconds.

18. The apparatus of claim 12 wherein the means for inserting comprises a gripper and a motor.

19. The apparatus of claim 12 wherein the housing comprises channels attached to a drive chain.

20. The apparatus of claim 12 comprising about 50 to about 30,000 ophthalmic lens packages.

* * * * *